US008795005B2

(12) United States Patent
Blakborn

(10) Patent No.: US 8,795,005 B2
(45) Date of Patent: Aug. 5, 2014

(54) HIGH-CURRENT INSERTION-TYPE CONNECTOR HAVING ANNULAR RESILIENT CONTACT

(75) Inventor: Willem Blakborn, Inzell (DE)

(73) Assignee: Rosenberger Hochfrequenztechnik GmbH & Co. KG, Fridolfing (DE)

( * ) Notice: Subject to any disclaimer, the term of this patent is extended or adjusted under 35 U.S.C. 154(b) by 0 days.

(21) Appl. No.: 14/001,738

(22) PCT Filed: Dec. 28, 2011

(86) PCT No.: PCT/EP2011/006596

§ 371 (c)(1),
(2), (4) Date: Aug. 27, 2013

(87) PCT Pub. No.: WO2012/119631

PCT Pub. Date: Sep. 13, 2012

(65) Prior Publication Data

US 2013/0330981 A1 Dec. 12, 2013

(30) Foreign Application Priority Data

Mar. 4, 2011 (DE) ..... 20 2011 003 555 U

(51) Int. Cl.
*H01R 11/09* (2006.01)

(52) U.S. Cl.
USPC ..... 439/788

(58) Field of Classification Search
USPC ..... 439/788, 626, 825, 840–841, 246, 249, 439/268, 264, 259, 843, 66, 86, 690, 654
See application file for complete search history.

(56) References Cited

U.S. PATENT DOCUMENTS

| | | | | |
|---|---|---|---|---|
| 4,632,496 | A * | 12/1986 | Williams | 439/841 |
| 5,588,884 | A | 12/1996 | Rudoy et al. | |
| 8,057,270 | B2 * | 11/2011 | Shimazu et al. | 439/827 |
| 8,437,855 | B2 * | 5/2013 | Sjostedt et al. | 607/37 |
| 8,480,437 | B2 * | 7/2013 | Dilmaghanian et al. | 439/669 |
| 2004/0224572 | A1 | 11/2004 | Hielscher et al. | |
| 2006/0270277 | A1 | 11/2006 | Zhao et al. | |
| 2010/0216354 | A1 | 8/2010 | Copper et al. | |

FOREIGN PATENT DOCUMENTS

DE 20 2010 010827 U1 10/2010

* cited by examiner

*Primary Examiner* — Edwin A. Leon
(74) *Attorney, Agent, or Firm* — DeLio, Peterson & Curcio, LLC; Robert Curcio

(57) ABSTRACT

A high current connector for transmitting electric currents, having a housing made of electrically conductive material for mechanical and electrical connection to a cable, an open side for the insertion of a matching plug connector made of an electrically conductive material, and a contact element disposed and formed in the housing such that it produces an electrical contact with a contact surface and contact pressure between the housing and the matching plug connector inserted therein, wherein the contact element has at least one annular helical spring.

4 Claims, 8 Drawing Sheets

HIGH-CURRENT INSERTION-TYPE CONNECTOR HAVING ANNULAR RESILIENT CONTACT

BACKGROUND OF THE INVENTION

1. Field of the Invention

The invention relates to a high-current insertion-type connector for transmitting electrical currents.

2. Description of Related Art

High-current insertion-type connectors of this kind, which are used to transmit particularly high electrical currents of for example an intensity of 100-400 A or more, find an application in, amongst other things, motor vehicles having electrical or hybrid drives. In this case the high-current insertion-type connector has a housing in which a blade contact acting as a mating insertion-type connector can be inserted. Both the housing and the blade contact are made of an electrically conductive material and are connected to appropriate cables for conducting electrical current.

In the case of high current insertion-type connectors of this kind, the requirement then exists for the reliable making of electrical contact to be achieved between the housing and the mating insertion-type connector while only a small amount of space is taken up, it being intended that this making of contact will ensure that high electrical currents are transmitted dependably even when there are high loads in the form of mechanical vibrations, but at the same time without the points of contact being subject to any wear worth mentioning as a result of, for example, abrasion.

This requirement has not yet been met satisfactorily in the high-current insertion-type connectors which have been known hitherto, which is attributable in particular to the insufficient electrical contact which is made.

SUMMARY OF THE INVENTION

Bearing in mind the problems and deficiencies of the prior art, it is therefore an object of the present invention to design the high-current insertion-type connector of the generic kind in such a way that the reliable making of electrical contact is achieved in every state of operation.

The features of the invention which is provided to achieve this object can be realized from the claims.

The above and other objects, which will be apparent to those skilled in the art, are achieved in the present invention which is directed to a high-current insertion-type connector for transmitting electrical currents, comprising: a mounting rail of electrically conductive material designed for mechanical and electrical connection to a cable, having an open end for the insertion of a mating insertion-type connector made of an electrically conductive material, and a contact-making member arranged and formed in the mounting rail, making electrical contact with a contact surface and produces contact-making pressure between the mounting rail and the mating insertion-type connector inserted therein, such that the contact-making member includes at least one annular helical spring; the annular helical spring insertable within a groove extending in a U-shape which is formed by a U-shaped contact-making point on the mounting rail and which receives the annular helical spring in such a way that the latter forms two main sub-divisions extending in parallel to receive the mating insertion-type connector and make contact with it.

The high-current insertion-type may include three annular helical springs arranged one behind the other provided in the mounting rail, and the annular helical spring may comprise windings at an oblique angle.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

Description Of The Preferred Embodiment(S)

In describing the preferred embodiment of the present invention, reference will be made herein to FIGS. 1-8 of the drawings in which like numerals refer to like features of the invention.

The high-current insertion-type connector according to the invention is so designed that the contact member, which is so designed and formed in the housing that it makes electrical contact with a contact surface and produces contact-making pressure between the housing and the mating insertion-type connector inserted therein, has at least one annular helical spring.

In an embodiment of the invention, this helical annular spring is inserted in a U-shaped groove which is formed in an electrically conductive mounting rail arranged in the housing and which receives the helical spring in such a way that the latter forms two main sub-divisions extending in parallel to receive the mating insertion-type connector and make contact with it.

This produces the crucial advantage that, while a particularly small amount of space is taken up, a reliable means of making electrical contact between the housing and the mating insertion-type connector is available which transmits high electrical currents dependably even when there are high loads in the form of mechanical vibrations, but at the same time without the points of contact being subject to any wear worth mentioning as a result of, for example, abrasion.

In a further embodiment of the invention, provision may be made for three helical annular springs arranged one behind the other to be provided in the mounting rail, which is preferably composed of copper. This improves the making of electrical contact between the mating insertion-type connector and the mounting rail or housing to an additional degree.

Further advantages are obtained if the helical annular springs have windings at an oblique angle. The advantageous effect is thereby achieved that a particularly high contact-making pressure is produced between the mating insertion-type connector and the mounting rail.

Figure 1:
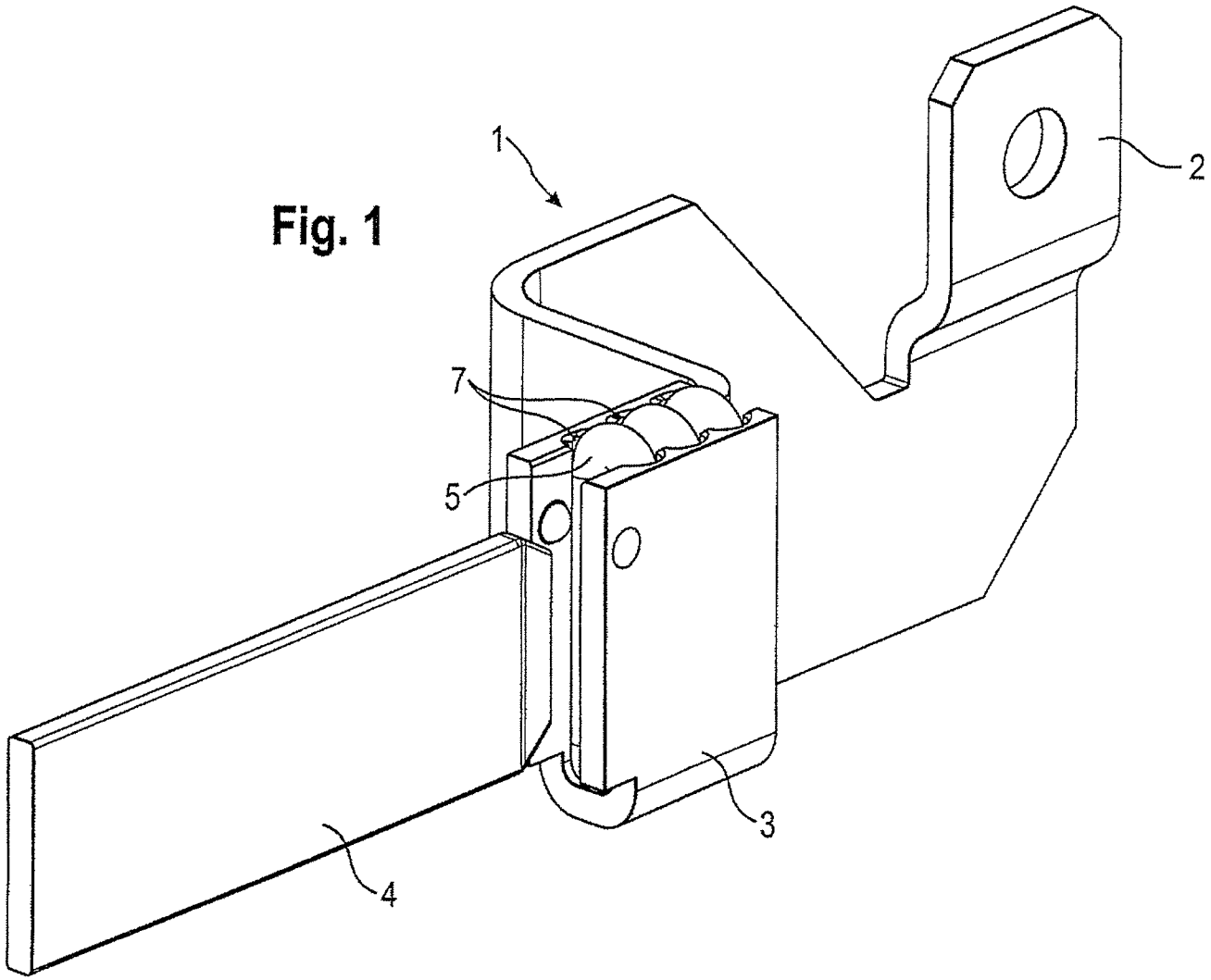
FIG. 1 is a perspective view of the electrically conductive mounting rail intended for arrangement in a housing of the high-current insertion-type connector, showing three helical annular springs inserted therein and a mating insertion-type connector in the course of the insertion process.
Figure 2:
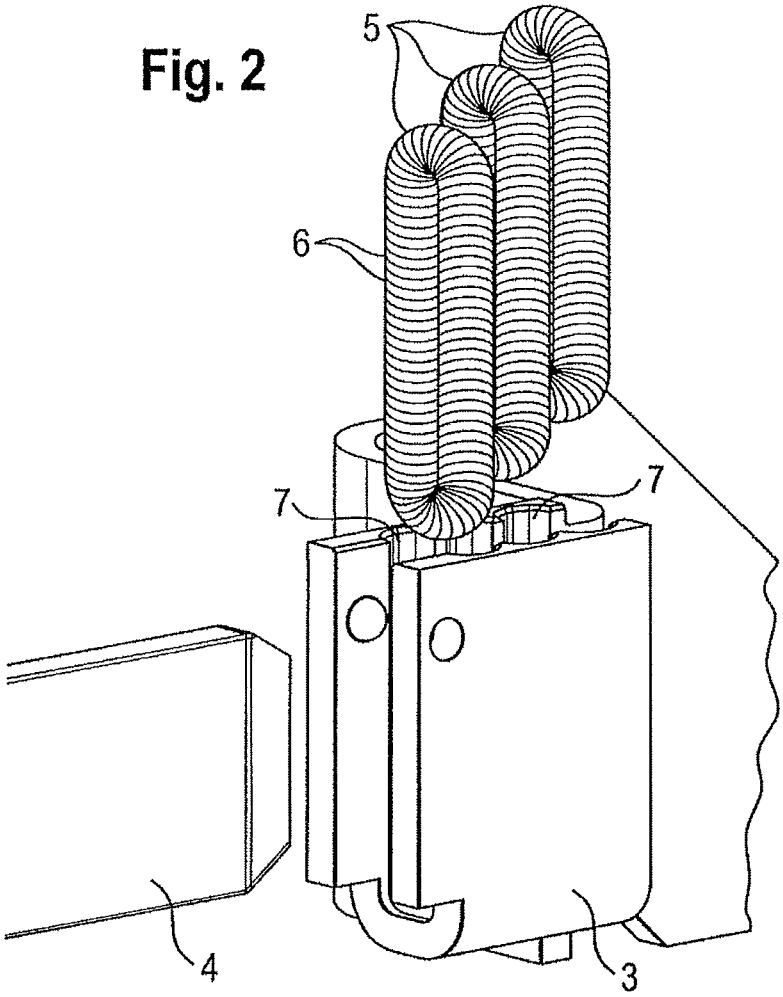
FIG. 2 is a perspective view of three helical annular springs shortly before they are inserted in U-shaped grooves in the mounting rail.
Figure 3:
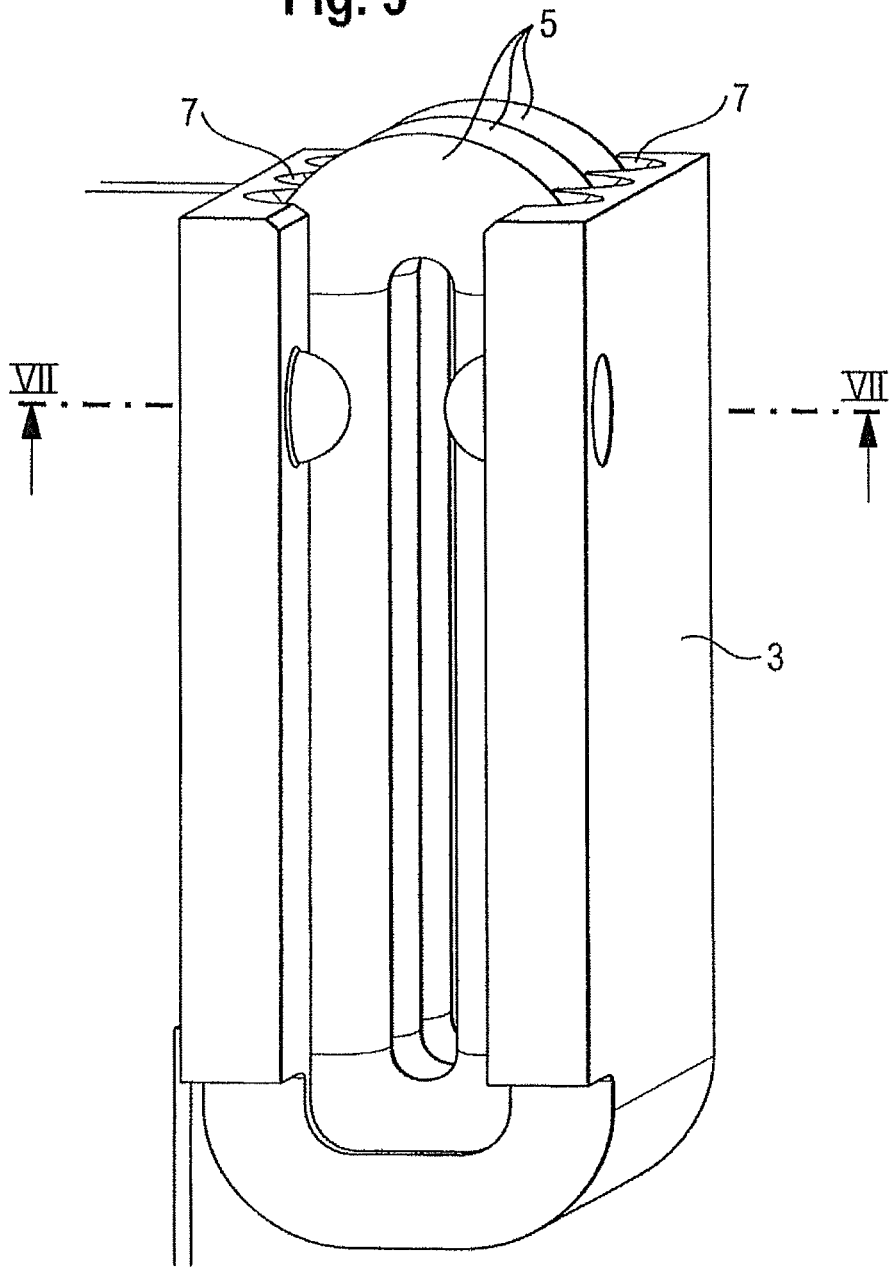
FIG. 3 is an enlarged perspective view of the helical annular springs when inserted in the grooves in the mounting rail.
Figure 4:
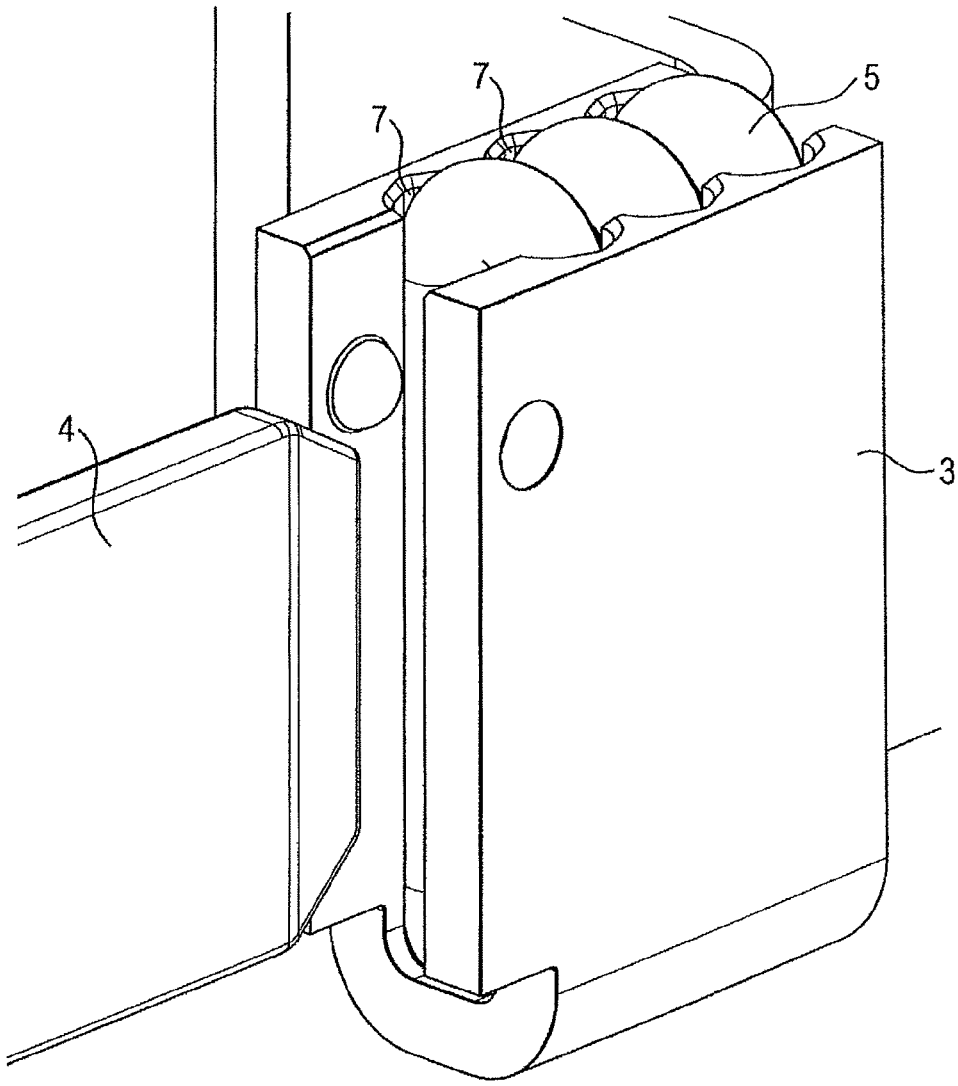
FIG. 4 is an enlarged perspective view of the mating insertion-type connector shortly before it is inserted in the main sub-divisions extending in parallel of the helical annular springs.
Figure 5:
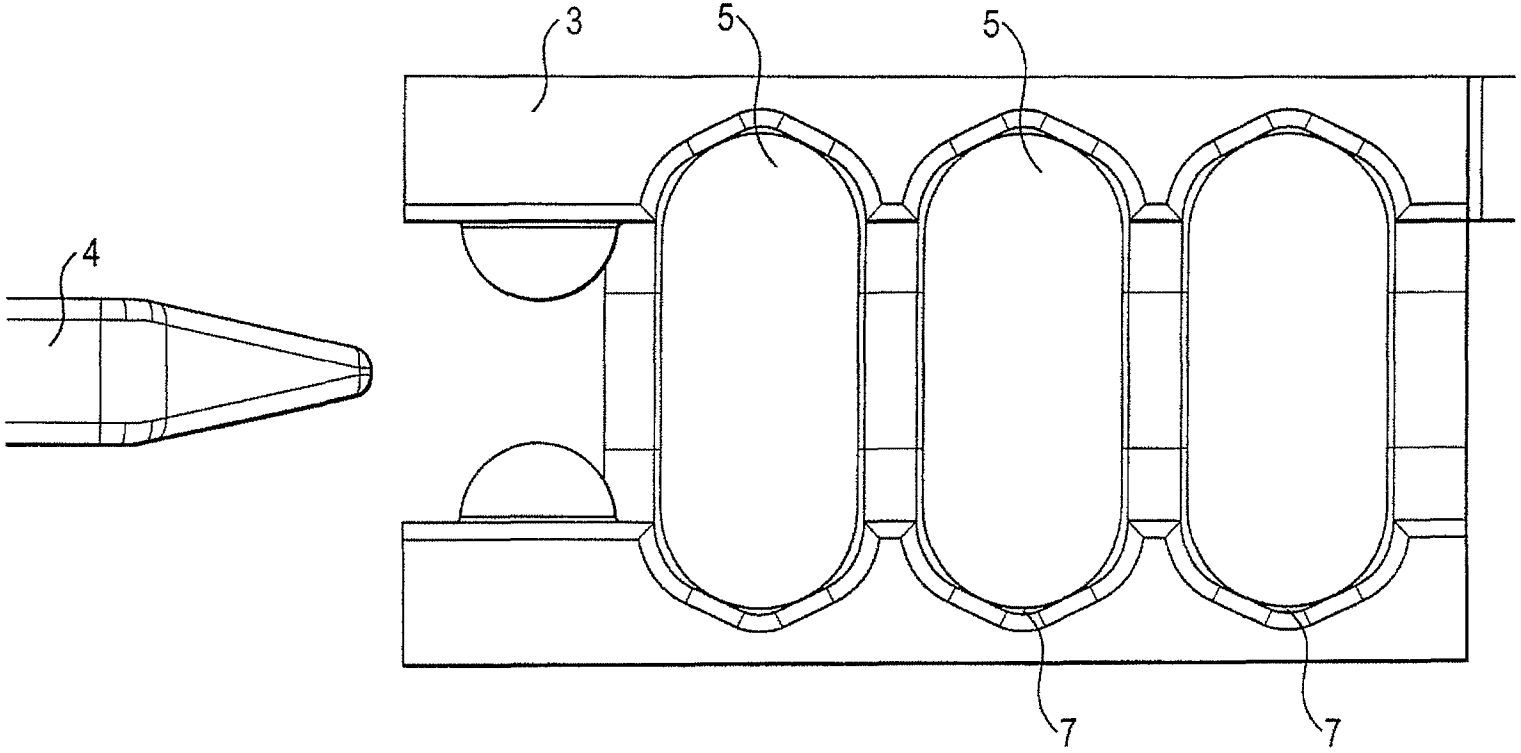
FIG. 5 is a plan view of the helical annular springs when inserted in the grooves in the mounting rail, showing the mating insertion-type connector shortly before it is inserted.
Figure 6:
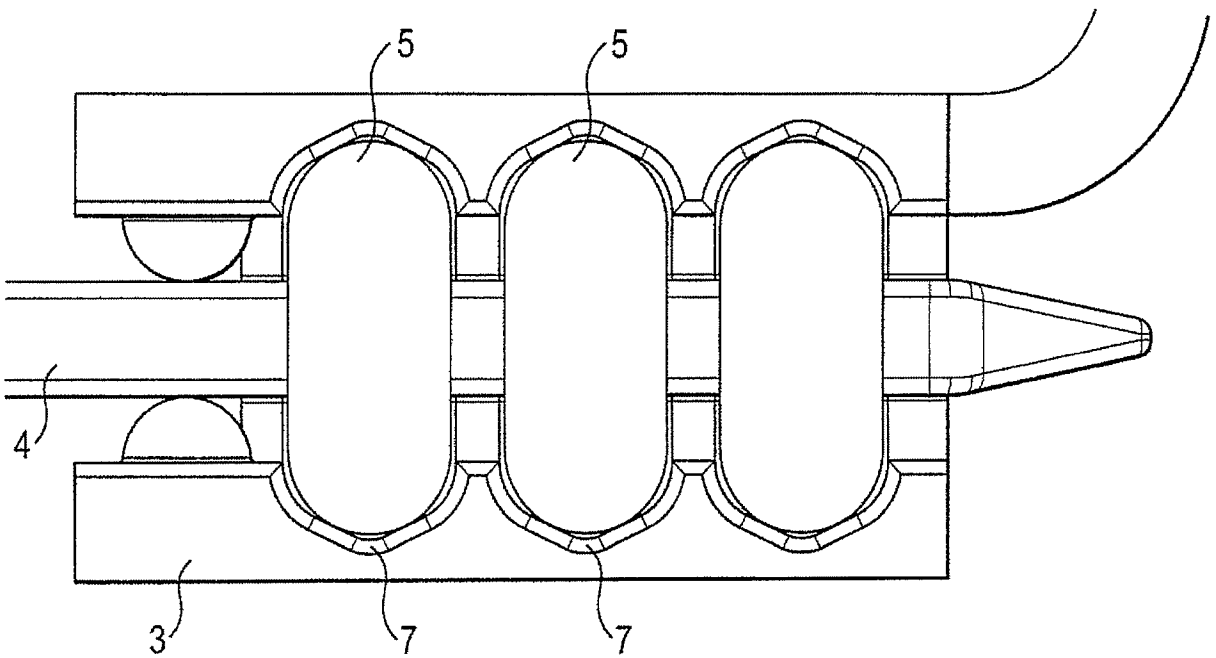
FIG. 6 shows the above with the mating insertion-type connector inserted.
Figure 7:
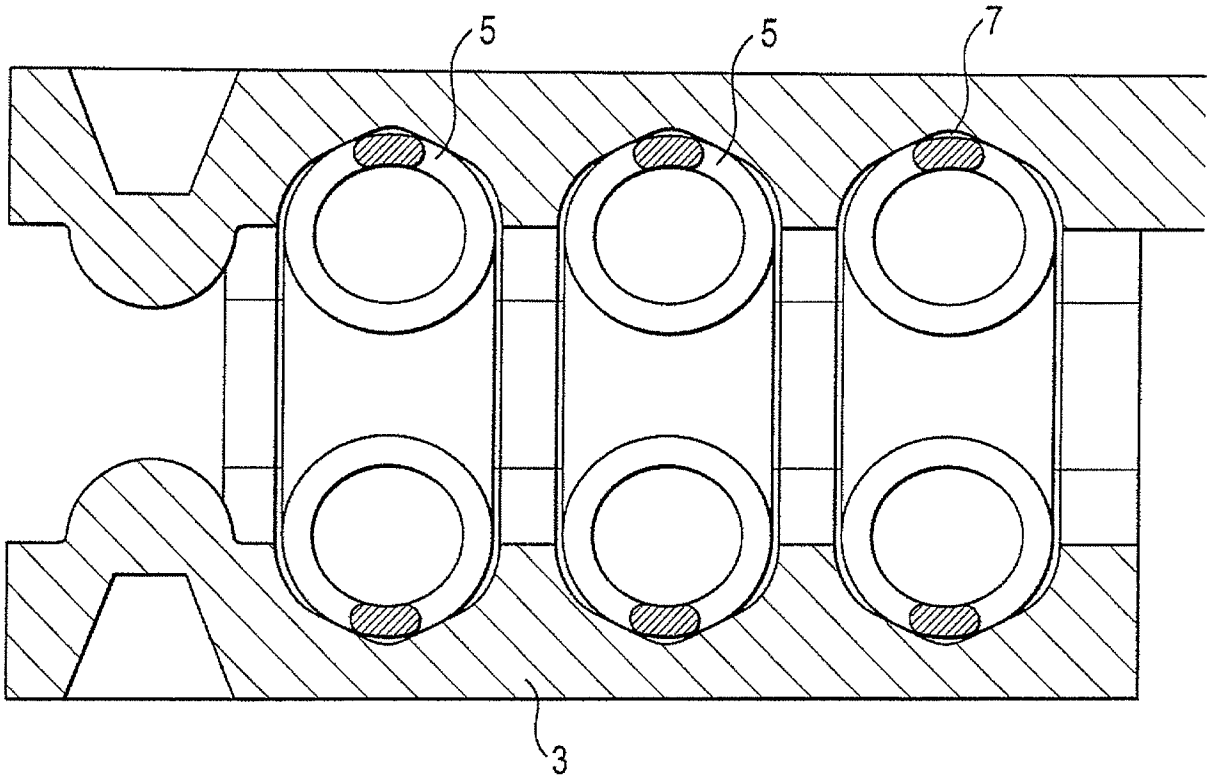
FIG. 7 shows the helical annular springs when inserted in the grooves in the mounting rail, in a section taken on line VII-VII in FIG. 3.
Figure 8:
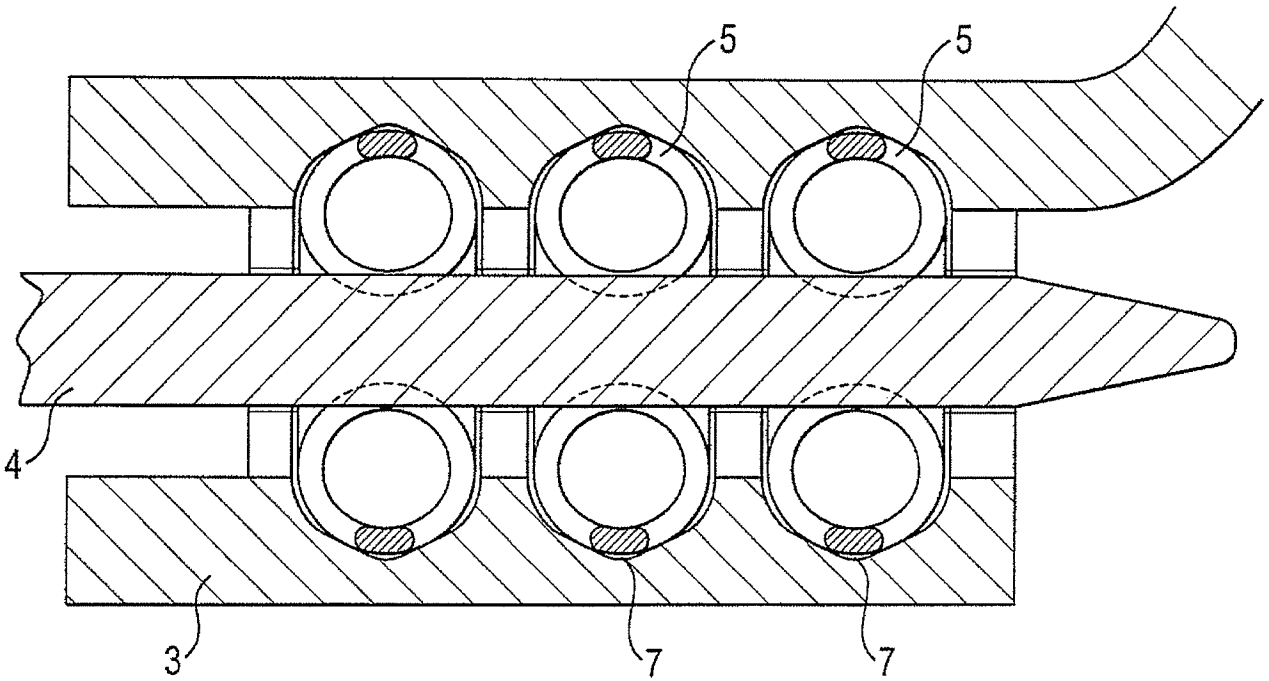
FIG. 8 shows the above with the mating insertion-type connector inserted.

As can be seen from the drawings, such as from FIGS. 1 and 2 for example, there is provided for the high-current insertion-type connector a mounting rail 1 which is composed of an electrically conductive material such for example as copper and which is arranged in a housing (not shown) which is likewise composed of an electrically conductive material. The mounting rail 1 has a cable end 2 for electrical and mechanical connection to an electrical cable for current (not shown).

Provided at the opposite end of the mounting rail 1 from the cable end 2 is a contact-making point 3 which is so formed and arranged that it receives a blade-like mating insertion-type connector 4 made of electrically conductive material.

Provided as members for contact between the mounting rail 1 on the housing side and the mating insertion-type connector 4 are three helical springs 5 which, as can be seen from FIG. 2, take the form of annular springs and whose windings 6 are at an oblique angle. The helical springs 5 are inserted in respective U-shaped grooves 7 which are formed at the contact-making point 3 and of which the clear width is such that the helical annular springs 5 when they are inserted in the U-shaped grooves 7 at the contact-making point 3, each form two main sub-divisions extending in parallel to receive the mating insertion-type connector 4 and make contact with it, and also receive the mating insertion-type connector 4 with an adequate contact-making pressure, as can be seen from FIG. 8. This highly effective making of contact between the mating insertion-type connector 4 and the helical annular springs 5 is very substantially assisted by the fact that, as shown, the helical annular springs 5 have windings 6 extending at an oblique angle.

For features of the invention which are not explained in detail above, attention is expressly directed to the claims and the drawings.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A high-current insertion-type connector for transmitting electrical currents, comprising:

a mounting rail of electrically conductive material designed for mechanical and electrical connection to a cable, having an open end for the insertion of a mating insertion-type connector made of an electrically conductive material, and a contact-making member arranged and formed in the mounting rail, making electrical contact with a contact surface and produces contact-making pressure between the mounting rail and the mating insertion-type connector inserted therein, such that the contact-making member includes at least one annular helical spring;

said annular helical spring insertable within a groove extending in a U-shape which is formed by a U-shaped contact-making point on the mounting rail and which receives the annular helical spring in such a way that the latter forms two main subdivisions extending in parallel to receive the mating insertion-type connector and make contact with it.

2. The high-current insertion-type connector of claim 1, including three annular helical springs arranged one behind the other provided in the mounting rail.

3. The high-current insertion-type connector of claim 1, wherein the annular helical spring comprises windings at an oblique angle.

4. The high-current insertion-type connector of claim 2, wherein the three helical annular springs each comprise windings at an oblique angle.

* * * * *